United States Patent [19]

Lin

[11] Patent Number: 4,759,240

[45] Date of Patent: Jul. 26, 1988

[54] ELECTRIC SCREWDRIVER WITH ADJUSTABLE JOINT

[76] Inventor: Samson Lin, 7Fl., No. 420, Sec. 1, Keelung Road, Taipei, Taiwan

[21] Appl. No.: 43,333

[22] Filed: Apr. 28, 1987

[51] Int. Cl.[4] ..... B25G 1/06

[52] U.S. Cl. ..... 81/177.8; 81/177.85; 81/54; 403/160

[58] Field of Search ..... 81/177.1, 177.7, 177.75, 81/177.85, 177.8, 177.9, 52, 54; 403/96–98, 160; 285/184

[56] References Cited

U.S. PATENT DOCUMENTS

| | | | |
|---|---|---|---|
| 2,542,038 | 2/1951 | Lewis | 403/160 X |
| 2,630,114 | 3/1953 | Hart | 403/160 X |
| 3,986,272 | 10/1976 | Feierabent | 403/160 X |
| 4,522,270 | 6/1985 | Kishi | 81/177.1 X |

*Primary Examiner*—Debra Meislin

*Attorney, Agent, or Firm*—Poms, Smith, Lande & Rose

[57] ABSTRACT

An electromotive screwdriver comprising a head assembly, a barrel, and a fixing assembly. The head assembly comprises a first inclined plane which is integrally formed with the housing of the head assembly and which is provided with a hollow ball, a channel and a ridge-like runner. The barrel comprises a second inclined plane which is integrally formed with the housing of the barrel and which is provided with a spherical recess, a serrated channel, and a box-shaped runner. The two planes can be engaged by adapting the ball into the spherical recess as well as inserting each runner into corresponding channel. The fixing assembly is disposed on the barrel which has a spring member that will urge the lug body into the first or second rectangular recesses provided on the first inclined plane of the head assembly through a rectangular opening on the second inclined plane.

1 Claim, 6 Drawing Sheets

ELECTRIC SCREWDRIVER WITH ADJUSTABLE JOINT

BACKGROUND OF THE INVENTION

This invention relates to electromotive screwdrivers, and more particularly, to an electromotive screwdriver with an adjustable joint.

Electromotive screwdrivers of varying sizes and shapes are well-known in the art. In particular, certain of such known screwdrivers utilize one or more dry cell batteries, carried in series in a tube serving as a handle for the screwdriver, as their source of electrical energy.

As will be seen in the drawings (FIG. 6), a conventional joint structure for electromotive screwdrivers comprises some bolts and nuts arranged in a constructon that can only be adjusted by bending in an awkward manner.

SUMMARY OF THE INVENTION

It is a primary object of the present invention to provide an electromotive screwdriver with an adjustable joint.

Another object of the present invetion is to provide an electromotive screwdriver with an adjustable joint that can be adjusted by a simple rotation.

A further object of the present invention is to provide such a joint construction for an electromotive screwdriver which is inexpensive to manufacture and relatively simple in structure.

The foregoing and further objects will become more apparent from a careful reading of the detailed description provided hereinafter, with appropriate reference to the attached drawings.

DETAILED DESCRIPTION OF THE PREFERRED EMBODIMENT

Figure 1:
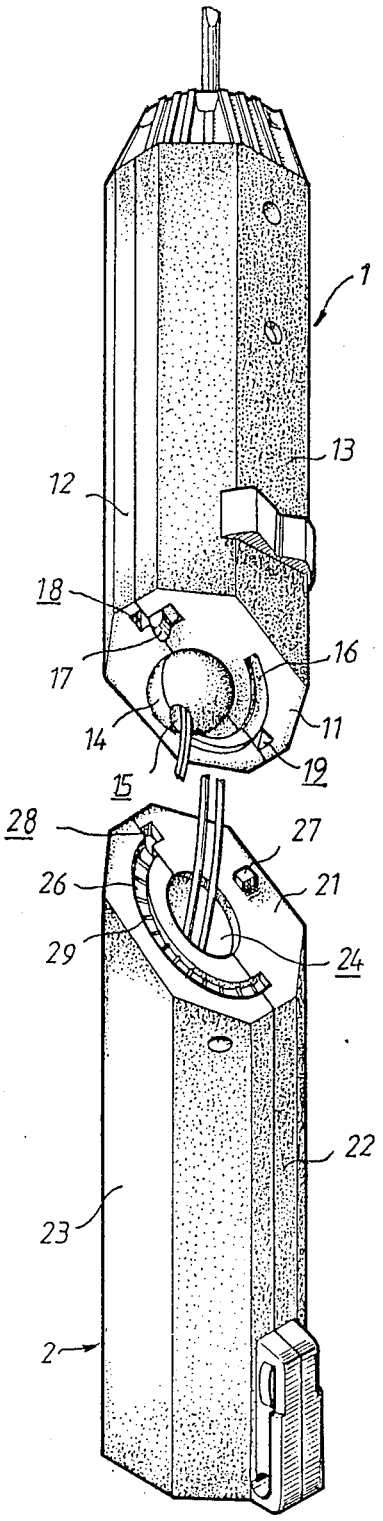
FIG. 1 is a perspective view of an electromotive screwdriver having its head assembly and its barrel separated in order to show a joint construction in accordance with the present invention.

Referring now to the drawings and initially to FIG. 1, it can be seen that an electromotive screwdriver constructed in accordance with the present invention comprises a head assembly 1, a barrel 2 acting as a handle of the electromotive screwdriver and a fixing means, such as a push-type fixing assembly 3 (refer to FIG. 3) to fix the electromotive screwdriver at a predetermined working position. A construction for joining the head assembly 1 and the barrel 2 comprises a flat inclined plane 11 on the bottom end of the head assembly 1 and a second inclined plane 21 on the top end of the barrel 2. The first inclinded plane 11 is integrally formed with the housing of the head assembly 1 which is, preferably, tubular in shape with a hexagonal cross-section and which includes a left piece 12 and a right piece 13 substantially identical in shape. The second inclined plane 21 is integrally formed with the housing of the barrel 2 which is also tubular in shape with a hexagonal cross-section and includes a left piece 22 and a right piece 23 substantially identical in shape. These pieces, 12 and 13, and 22 and 23 are combined to form the housing of the head assembly 1 and the barrel 2, respectively, by screws or like means.

Figure 2A:
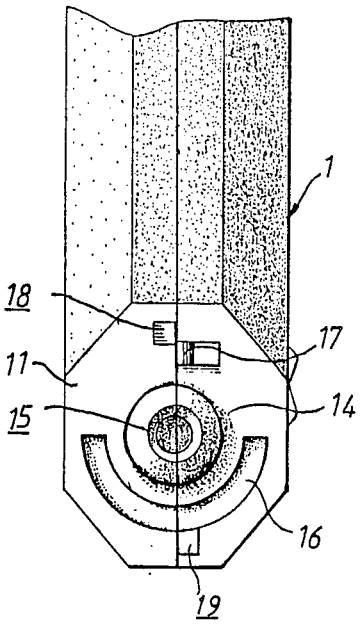
FIG. 2A is a view normal to an inclined plane of the head assembly illustrating the structure thereof.

Referring to FIGS. 1 and 2A, it can be seen that the first inclined plane 11 formed by the two pieces 12 and 13 of the head assembly 1 comprises a hollow ball 14 having an opening 15 on the central portion thereof, a semi-circular channel 16 peripherally disposed on the first inclined plane 11 encompassing half of said ball 14, a ridge-like runner 17 protruding from the right piece 13 of the first inclined plane 11 at a side opposite to the center of said channel 16, a first rectangular recess 18 formed on the left piece 12 and positioned adjacent to the ridge-like runner 17, and a second rectangular recess 19 formed on the right piece 13 and positioned adjacent to the semi-circular channel 16 at a position opposite to said first rectangular recess 18.

Figure 2B:
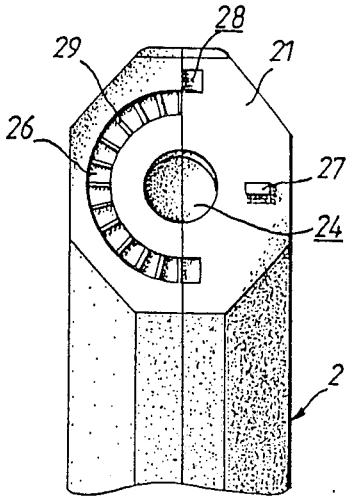
FIG. 2B is a view normal to an inclined plane of the barrel illustrating the structure thereof.

Referring to FIGS. 1 and 2B, it can be seen that the second inclined plane 21 formed by the two pieces 22 and 23 of the barrel 2 comprises: a spherical recess 24 having an opening 25 (see FIG. 5A) at the central bottom portion thereof; a serrated channel 26 peripherally disposed on the second inclined plane 21 substantially on the right piece 23 and encompassing half of said spherical recess 24; a box-shaped runner 27 protruding from the left piece 22 of the second inclined plane 21 at a side opposite to said serrated channel 26; and a rectangular opening 28 formed on the left piece 22 and being positioned adjacent to the serrated channel 26. The serrated channel 26 has a plurality of toothed-members 29 arranged in consecutive manner thereon. The number of the toothed-members is not critical, there should preferably be twelve toothed-members.

Figure 3:
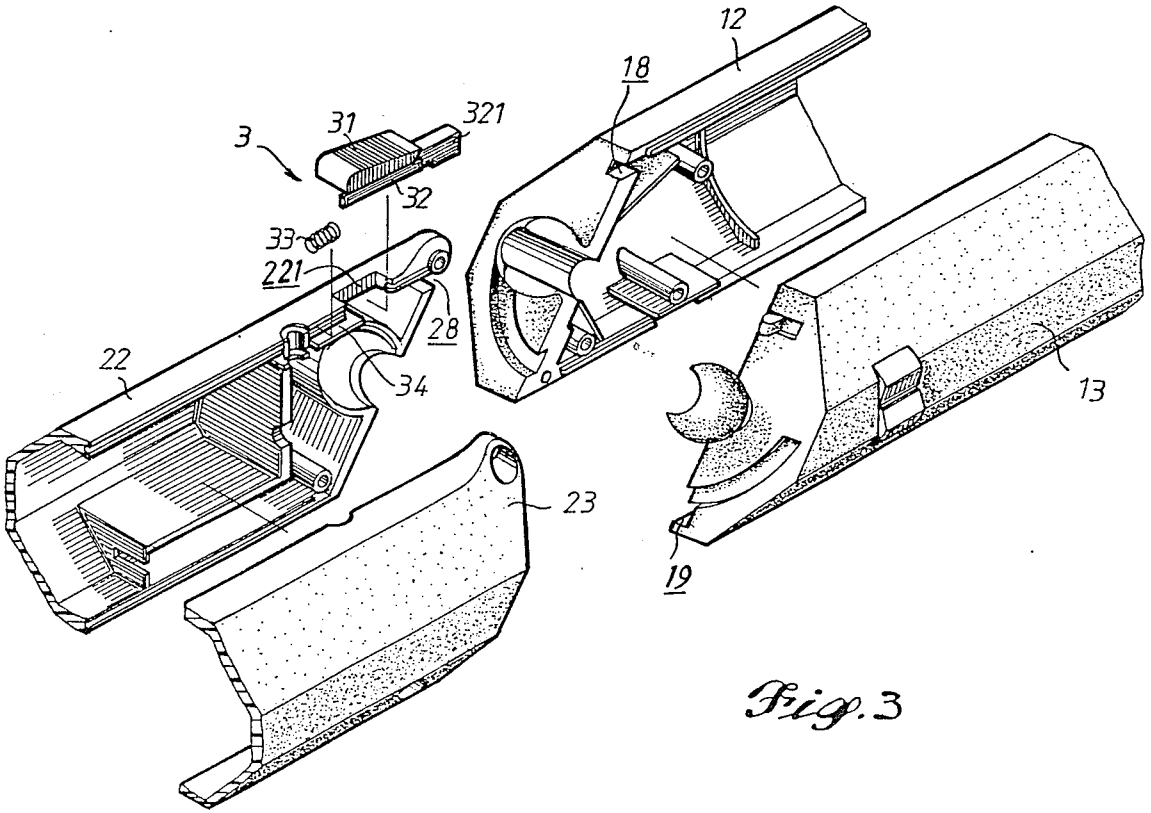
FIG. 3 is a perspective, exploded, fragmentary view showing a joint construction and a fixing means for said joint construction in accordance with the present invention.

Referring to FIG. 3, it can be seen that a fixing means, for example a push-type fixing assembly 3, is provided at the longer interface of the two pieces 22 and 23 of the barrel 2. The left piece 22 has a slit 221 at a position near the second inclined plane 21. Inside the barrel 2, a space is available for the storage of the push-type fixing assembly 3 which connects to the rectangular opening 28 disposed on said second inclined plane 21. The fixing assembly 3 includes a push rod 31 disposed on the exterior of the housing of the barrel 2, a lug body 32 which is connected to a lower edge of the push rod 31 and is retained inside the barrel 2, and a spring member 33 being positioned inside the barrel and behind said lug body 32. A rectangular head portion 321 extends from the lug body 32 and is also retained inside the barrel 2 and can move in or out through the rectangular opening 28 on the second inclined plane 21 of the barrel 2 and engage with the first or second rectangular recess, 18 or 19, disposed on the head assembly 1. A supporting blade 34 is disposed in a location corresponding to the slit 221 on the left piece 22. Said lug body 32 and its head portion 321 fit in position between the slit 221 and the supporting blade 34.

Figure 4B:
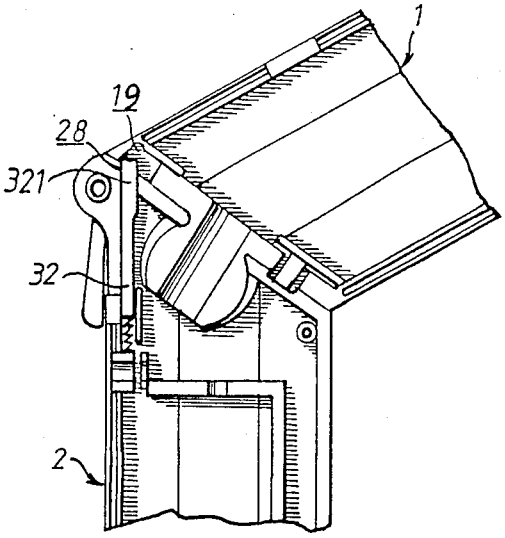
FIG. 4B is a fragmentary view similar to FIG. 4A, but showing the fixing means in a locked state.
Figure 4A:
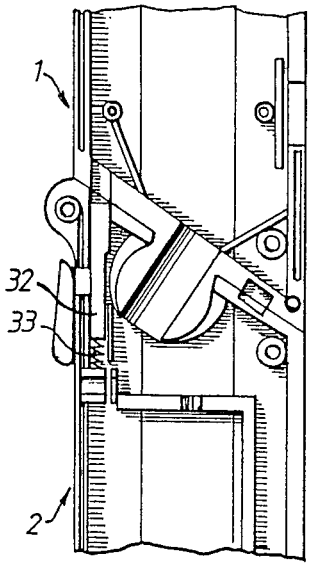
FIG. 4A is a fragmentary view showing the left hand pieces of a head assembly and a barrel with a fixing means in an unlocked state.

Referring to FIG. 4A, when the head assembly 1 and the barrel 2 are held in a straight line form, the lug body 32 tends to move forward because of the force exerted by the spring member 33 and that the head portion 321 of the lug body 32 is caught in the first rectangular recess 18, thereby fixing the head assembly 1 and the barrel 2 in said straight line form.

When the push rod 31 is pushed backward, the head portion 321 of the lug body 32 will leave the first rectangular recess 18 and the screwdriver can be re-adjusted. The screwdriver can be fixed in a bent manner as shown in FIG. 4B, after it has been adjusted by 180 degrees rotation of the barrel 2 about the ball 14 and that the box-shaped runner 27 sliding in the semicircular channel 16 from one terminal to the other terminal and the ridge-like runner 17 sliding in the serrated channel 26 from one terminal to the other terminal, thereby aligning the second rectangular recess 19 with the position of the rectangular opening 28. Consequently, the head portion 321 of the lug body 32 passes through the rectangular opening 28 and engages with the second rectangular recess 19 of the head assembly 1. Thus, the predetermined positioning of the screwdriver is fixed. The working of the electromotive screwdriver can therefore be carried out smoothly. By pushing the push rod 31 backwards, the lug body 32 and its head portion 321 are urged to slide back to the inside of the barrel 2 and the respective runners of the head assembly 1 and the barrel 2 are freely slidable along the corresponding channels thereof.

Figures 5A, 5B, 5C:
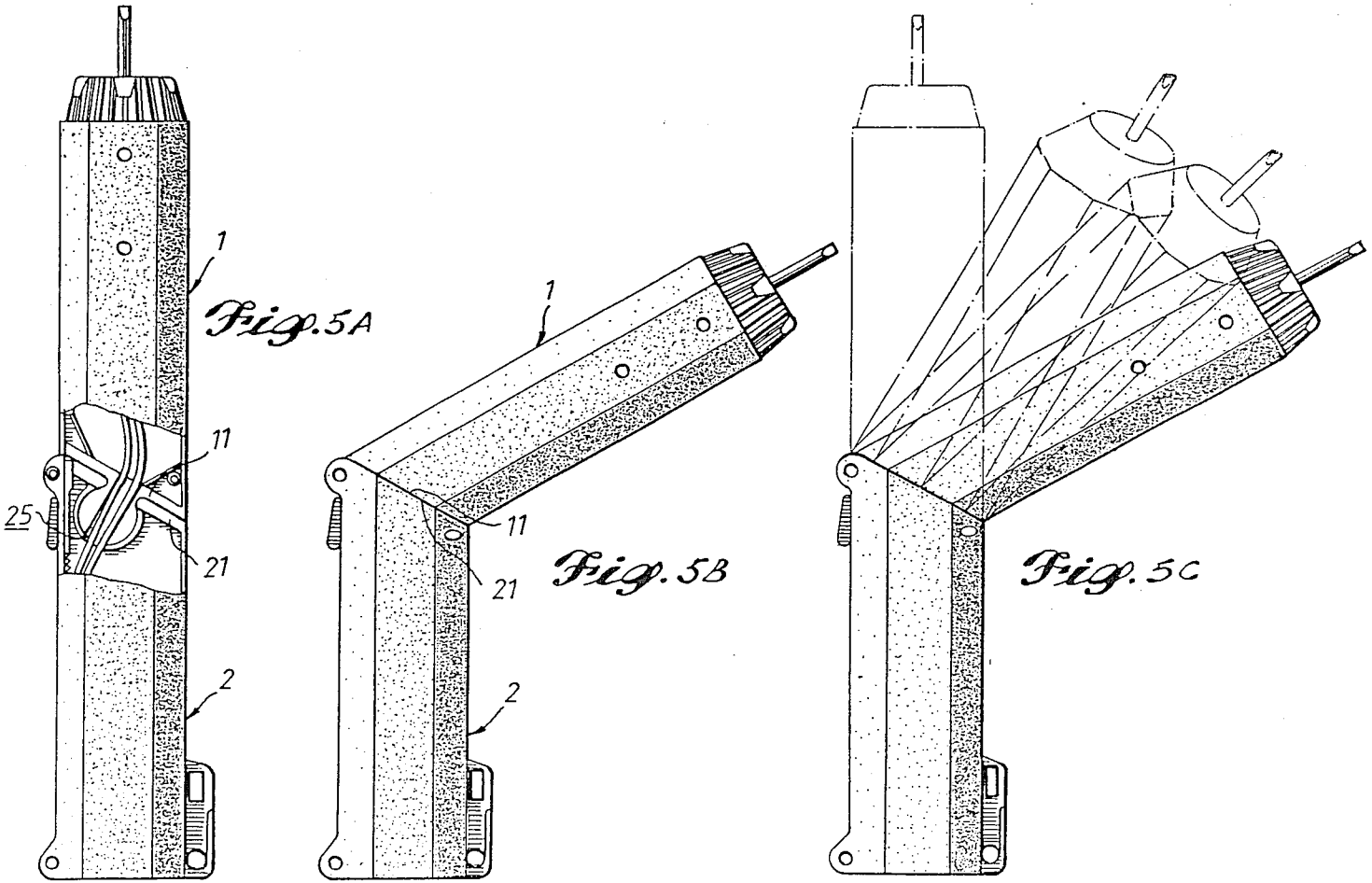
FIG. 5A is a schematic view showing an electromotive screwdriver in a state where the slant angle between the head assembly and the barrel is zero degrees, with a central portion being broken away to illustrate the internal structure thereof.
FIG. 5B is a schematic view similar to FIG. 5A, but showing the maximum slant angle between the head assembly and the barrel.
FIG. 5C is a schematic view similar to FIG. 5A, but showing various possible slant angles between the head assembly and the barrel in solid and broken lines.
Figure 6:
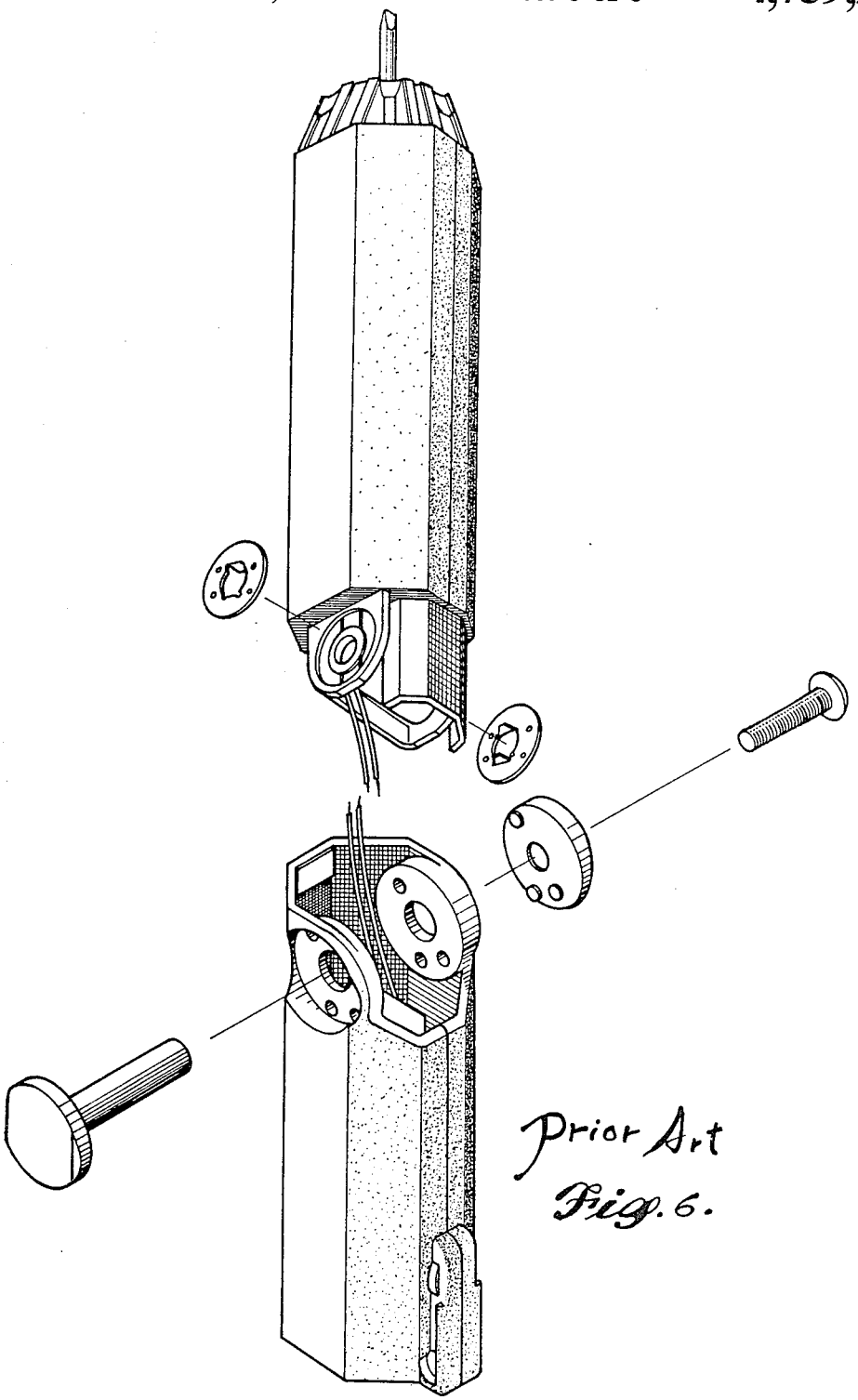
Prior Art Fig. 6.
FIG. 6 is a perspective veiw of an electromotive screwdriver having its head assembly and its barrel separated to show a conventional joint construction.

Referring next to FIGS. 5A, 5B and 5C, it can be seen that the electromotive screwdriver can therefore be set in: (1) a straight form (FIG. 5A), i.e., a slant angle of zero degrees is set between the head assembly 1 and the barrel 2; or (2) a bent form (FIG. 5B), i.e., a maximum slant angle 0 degrees is set between the head assembly 1 and the barrel 2. Still, the screwdriver can be rotated to various positions between straight form and bent form, as shown in FIG. 5C.

It can also be understood from FIG. 5A that wires carrying electrical energy from dry cell batteries (not shown) resided in the barrel 2 to a motor (not shown) resided in the head assembly 1 pass through the opening 25 formed in the spherical recess 24 and the opening 15 formed on the hollow ball 14.

While the invention has been explained in relation to its preferred embodiment, it is to be understood that various modifications thereof will become apparent to those skilled in the art upon reading this specification. Therefore, it is to be understood that the invention disclosed is intended to cover such modifications as fall within the scope of the appended claims.

I claim:

1. An electromotive screwdriver comprising:

(a) a head assembly having a first inclined plane integrally formed on a bottom end of a housing of the head assembly, said first inclined plane being provided with:

a hollow ball having an opening on a central portion thereof;

a semi-circular channel peripherally disposed on said first inclined plain and encompassing half of said hollow ball;

a ridge-like runner protruding from said first inclined plane at a side of said plane opposite to said channel;

a first rectangular recess formed in said plane positioned adjacent to said ridge-like runner; and a second rectangular recess positioned adjacent to said channel at a position opposite to said first rectangular recess;

(b) a barrel having a second inclined plane integrally formed with a housing of the barrel, said second inclined plane being provided with:

a spherical recess having an opening at a central bottom portion thereof;

a serrated channel having a plurality of toothed-members thereon, said serrated channel being peripherally disposed on said second inclined plane and encompassing half of said spherical recess;

a box shaped runner protruding from said second inclined plane at a side of said second plane opposite to said serrated channel; and a rectangular opening positioned adjacent to said serrated channel;

(c) a fixing assembly disposed within the barrel comprising:

a push rod protuding through an exterior opening of the housing of said barrel;

a lug body having a rectangular head portion extending therefrom which is connected to a lower face of said push rod and which is retained inside said barrel; and a spring member positioned inside the barrel and at a position behind said lug body; and (d) said head assembly being engageable to said barrel by adapting the hollow ball of said assembly into the spherical recess of said barrel, the ridge-like runner of said head assembly being slidable along the serrated channel of said barrel, the box-shaped runner of said barrel being slidable along the semicircular channel of the said head assembly, and the lug body of said fixing means being catchable by the first and the second rectangular recesses of the head assembly through a rectangular opening on said barrel.

* * * * *